US007559792B2

(12) United States Patent
Lin et al.

(10) Patent No.: US 7,559,792 B2
(45) Date of Patent: Jul. 14, 2009

(54) CONNECTOR WITH EASILY REPLACEMENT OF A SLIDER

(75) Inventors: Min-Han Lin, Tu-Cheng (TW); Guo-Jiun Shiu, Tu-Cheng (TW); Ti-Li Wei, Tu-Cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/975,973

(22) Filed: Oct. 23, 2007

(65) Prior Publication Data

US 2008/0096430 A1 Apr. 24, 2008

(30) Foreign Application Priority Data

Oct. 23, 2006 (TW) ..... 95218688 U

(51) Int. Cl.
*H01R 12/24* (2006.01)

(52) U.S. Cl. ..... 439/495; 439/940

(58) Field of Classification Search ..... 439/135, 439/260, 495, 940
See application file for complete search history.

(56) References Cited

U.S. PATENT DOCUMENTS 5,474,468 A * 12/1995 Chishima et al. ..... 439/495
5,816,845 A 10/1998 Chishima
6,004,156 A * 12/1999 Roque et al. ..... 439/495
6,238,238 B1 * 5/2001 Hwang et al. ..... 439/495
6,475,025 B2 * 11/2002 Inoue ..... 439/495
6,475,026 B1 * 11/2002 Tseng et al. ..... 439/495
7,044,774 B2 * 5/2006 Asai ..... 439/495

* cited by examiner

*Primary Examiner*—Thanh-Tam T Le
(74) *Attorney, Agent, or Firm*—Wei Te Chung

(57) ABSTRACT

An electrical connector (100) comprises an insulative housing (1) with pluralities of terminals (2, 4) thereon. The housing comprises two opposite sidewalls (101, 102), two opposite endwalls (103) respectively located on two ends of the sidewalls and a receiving cavity (10) defined therebetween with an opening. A first and a second retaining wall (16, 17) are located on each endwall (103) to define a groove (12) theretween, wherein the groove (12) defines a first latching portion (13) adjacent to the first retaining wall (16) near to the opening of the receiving cavity, and an entry (106) is defined between the first latching portion (13) and the second retaining wall (17). The slider (3) comprises a base plate (30), a tongue plate (32) insertable to the receiving cavity and two latching arms (33) insertable to the groove (12) through the entry (106).

2 Claims, 6 Drawing Sheets

CONNECTOR WITH EASILY REPLACEMENT OF A SLIDER

BACKGROUND OF THE INVENTION

1. Field of the Invention

The present invention relates to an electrical connector, and more particular to an electrical connector for a sheet-like connection member such as a flexible printed circuit (FPC), a flexible flat cable and so forth.

2. Description of Related Art

U.S. Pat. No. 5,816,845 discloses a conventional connector adapted for connecting a flexible printed circuit (FPC). The connector comprises a insulating housing having an insertion cavity into which the FPC is adapted to be inserted and a pair of guiding grooves respectively at two ends thereof. A plurality of metal terminals is mounted on the housing. A projection is formed on each guiding grooves adjacent to an insertion port of the cavity and a sliding member with two arms at two opposite ends thereof is pushed into the guide groove across the projection.

However, when assembling the sliding member into the cavity, the arms made of plastic material, which get across the projection into the guiding grooves, may be broken. Furthermore, after the connector is mounted on a printed circuit board (PCB), it is difficult to replace a new sliding member if the sliding member is damaged during using. Therefore, a new design is required.

SUMMARY OF THE INVENTION

An object of the present invention is to provide an electrical connector with easily replacement of a slider.

In order to achieve above-mentioned objects, an electrical connector for a sheet-like connection member in accordance with the present invention comprises an insulating housing including a long wall, a short wall and a pair of endwalls beside said two walls, and said four walls forming a receiving cavity. A first and a second retaining wall parallel to the long wall and the short wall are formed at each side of the endwalls. A groove is formed by said two retaining walls with a first latching portion adjacent to the first retaining wall, and an entry is defined between the first latching portion and the second retaining wall. A slider comprises a tongue plate insertable into the receiving cavity and a pair of latching arms. The latching arms are assembled into the groove from the entry and then slide in the groove.

Other objects, advantages and novel features of the present invention will become more apparent from the following detailed description of the present embodiment when taken in conjunction with the accompanying drawings.

DETAILED DESCRIPTION OF THE INVENTION

Figure 1:
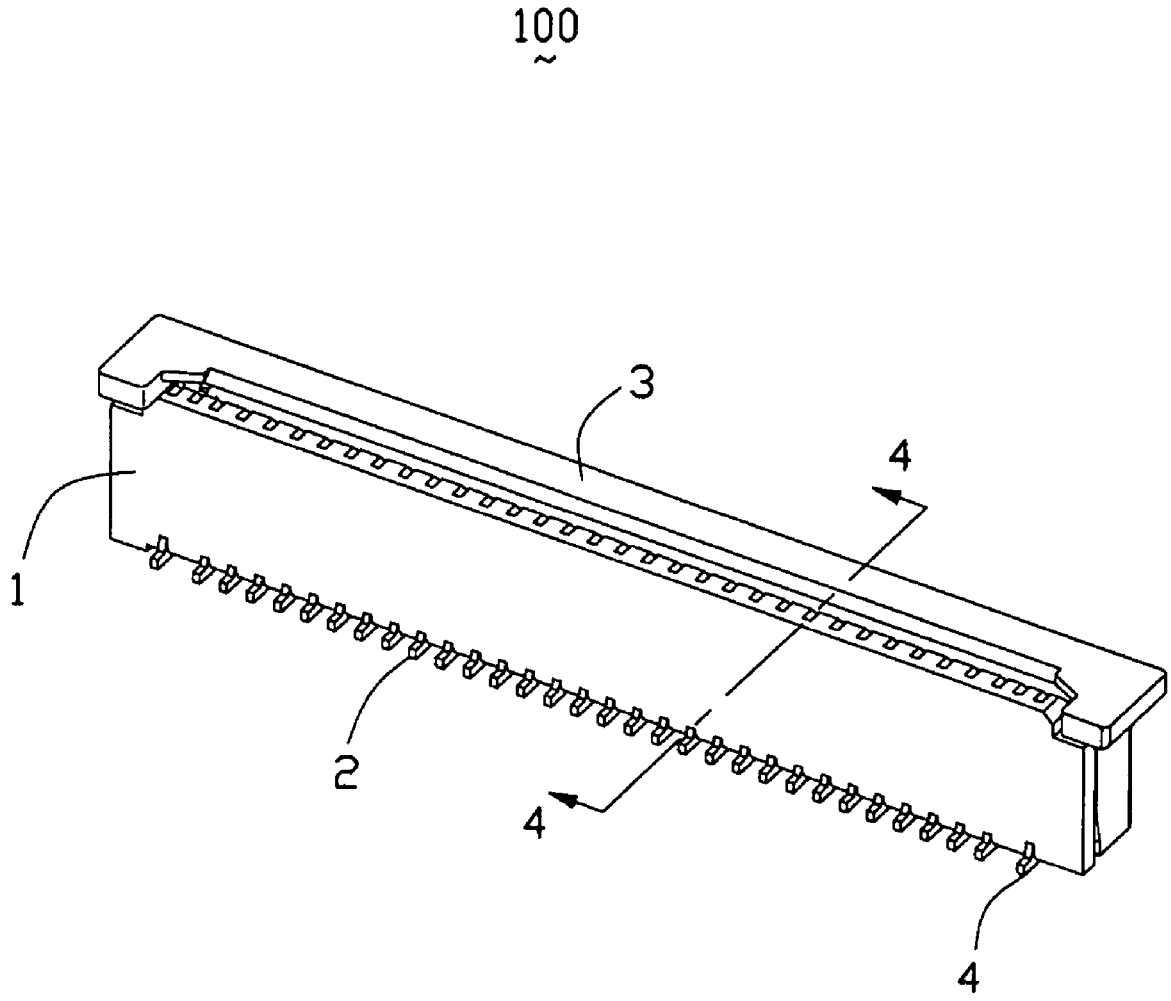
FIG. 1 is an assembled perspective view of an electrical connector in accordance with the present invention.

Reference will now be made to the drawing figures to describe the preferred embodiment of the present invention in detail.

Referring to FIG. 1, an electrical connector 100 for connecting a sheet-like connection member (not shown) in accordance with the present invention is provided. The electrical connector comprises an insulative housing 1 defining a longitudinal direction, a plurality of conductive terminals 2 disposed in the housing 1, a slider 3 of non-electrically-conductive material, and a pair of retaining terminals 4.

Figure 2:
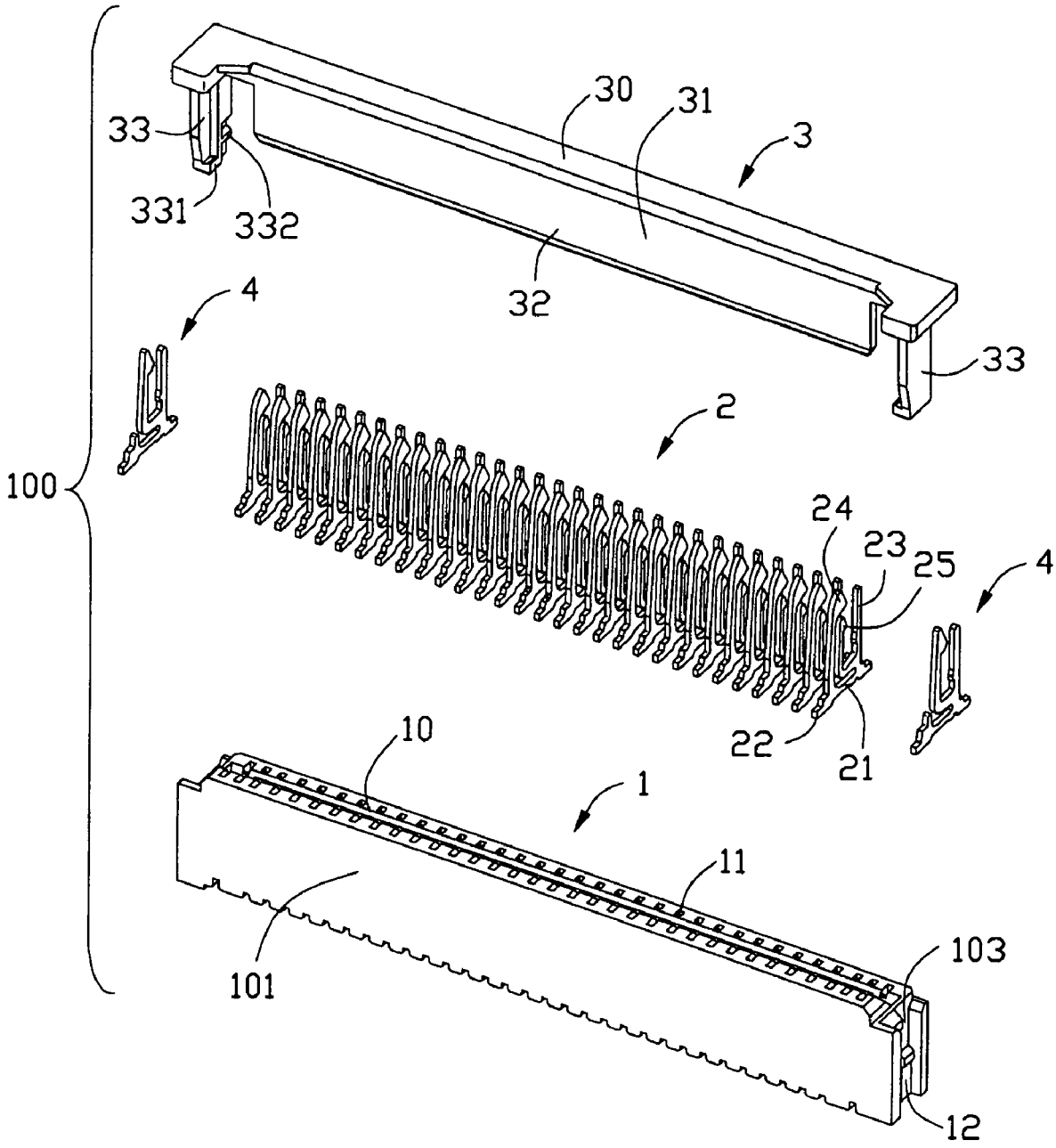
FIG. 2 is an exploded perspective view of the electrical connector.
Figure 3:
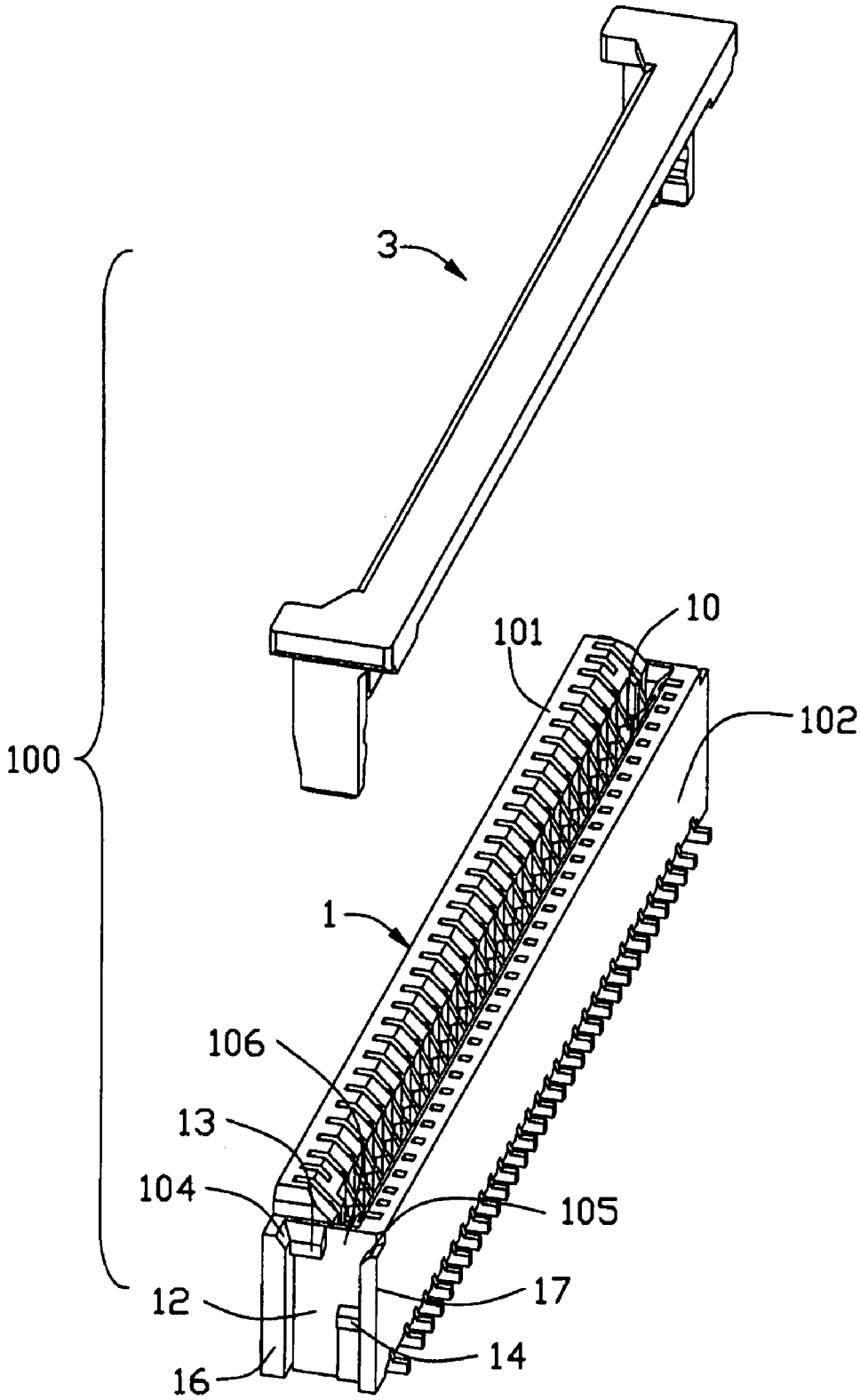
FIG. 3 is a partly-exploded perspective view of the electrical connector.

Referring to FIGS. 2 and 3, the housing 1 comprises a front wall 101, a back wall 102 lower than the front wall, two endwalls 103 respectively connecting the front and back walls and a receiving cavity 10 therebetween. The front wall 101 and the back wall 102 respectively define a plurality of terminal grooves 11 vertical to the longitudinal direction of the housing 1 and communicating with the receiving cavity 10. The conductive terminals 2 and the retaining terminals 4 are retained in the terminal grooves 11.

Figure 4:
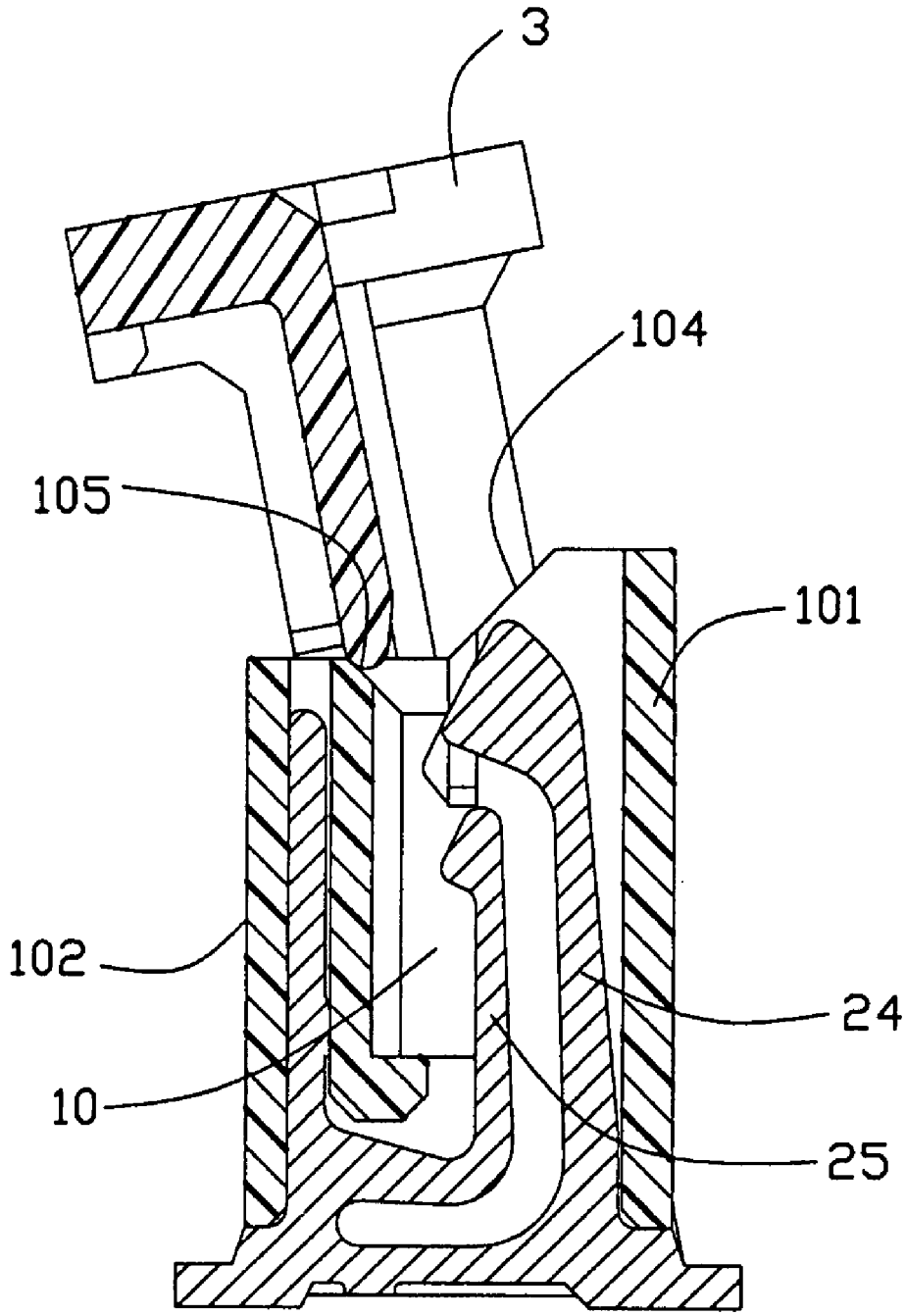
FIG. 4 is a cross-sectional view of the electrical connector shown in FIG. 1 taken along line 4-4, wherein a slider is pulled out and inclines against a short wall.

Each conductive terminal 2 comprises a base section 21, a pair of solder portion 22 extending out from two opposite ends of the base section 21 to be soldered on a PCB (not shown), a fixing arm 23 extending upwards from the base section 21 to be retained in terminal groove 11 defined by the back wall 102, a first resilient arm 24 extending substantially parallel to the fixing arm 23, and a second resilient arm 25 branching from a root portion of the fixing arm 23 and extending upwards parallel to the first resilient arm 24. Both of the resilient arms 24, 25 are received in the terminal grooves 11 together defined by the front wall 101, and the first resilient arm 24 is longer than the fixing arm 23, i.e. nearer to an insertion open of the receiving cavity 10, as best shown in FIG. 4.

The connector 100 further has a pair of retaining terminals 4. The structure of the retaining terminal 4 is similar to the conductive terminal 2, but without a second resilient arm.

Referring to FIG. 3, the front and back walls 101,102 respectively extend outwards along the longitudinal direction and beyond the endwalls 103 to respectively form a first retaining wall 16 and a second retaining wall 17. A groove 12 is defined between said two retaining walls with a first latching portion 13 adjacent to the first retaining wall 16 at the front open thereof and an entry 106 is defined between the first latching portion 13 and the second retaining wall 17. A second latching portion 14 in the groove 12 is formed in the middle portion of the groove and adjacent to the second retaining wall 17. Slanting surfaces 104,105 are respectively formed on top of the first and second retaining walls 16, 17.

Referring to FIG. 2, the slider 3 has a rectangular base plate 30 with an open 31 at one side thereof, a tongue plate 32 vertically extending from the base plate and a pair of latching arms 33 extending from longitudinal ends of the base plate. The base plate 30 defines a slanting surface (not figured) at its distal end for easily being inserted into the receiving cavity 10. The latching arms 33 are spaced with the tongue plate 32 and slide in the corresponding grooves 12. The latching arm 33 is excavated partly at its side along a extending direction thereof and forms a hook shaped grasping portion 331 at its distal end. The other side of the latching arm 33 is also excavated partly and forms a retaining portion 332.

Figure 5:
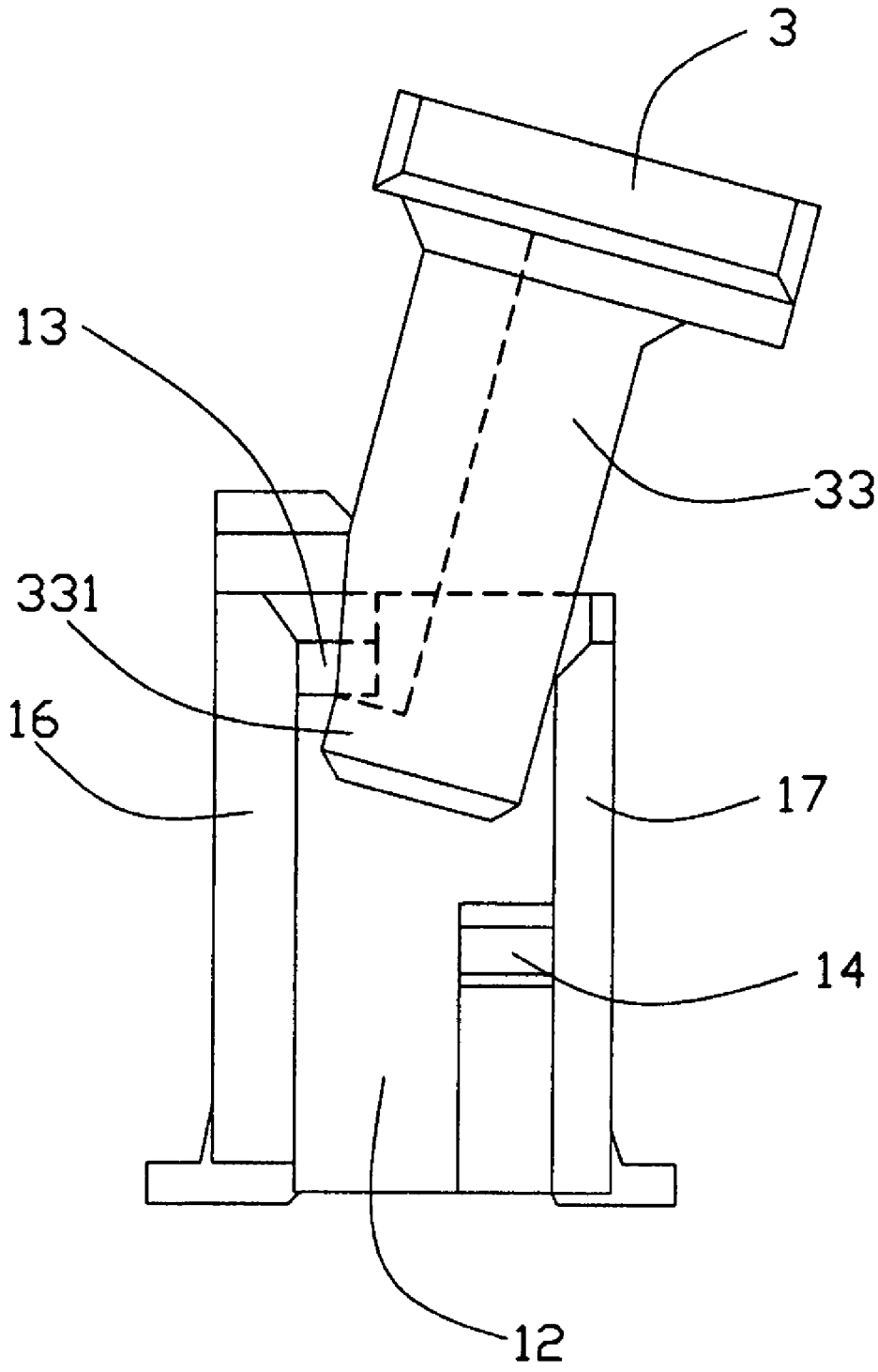
FIG. 5 is a side-view of the electrical connector shown in FIG. 1, wherein the slider inclines against the short wall.

Referring to FIG. 5 showing an open position of the slider 3 to the housing, the slider 3 is assembled on the housing 1 with the latching arms 33 in the grooves 12. When the slider 3 is drawn upwards and inclines against the second retaining wall 17 with an inner-side of the grasping portion 331 blocked by the first latching portion 13, firstly insert the FPC into the receiving cavity 10 through the gap 31 of the slider 3, and then push the slider downwards, wherein the latching arms 33 slide downward the grooves 12 until the retaining portions 332 of the latching arms 33 is engaged with the second latching portions 14. Therefore, the tongue plate 32 is inserted into the receiving cavity 10 and pushes the FPC electrically engaged with the conductive terminals 2, and completely-retained-position of the FPC is formed. When pull the slider 3 upward, wherein the retaining portion 332 is released from the second latching portions 14, the FPC is drawn out easily.

Figure 6:
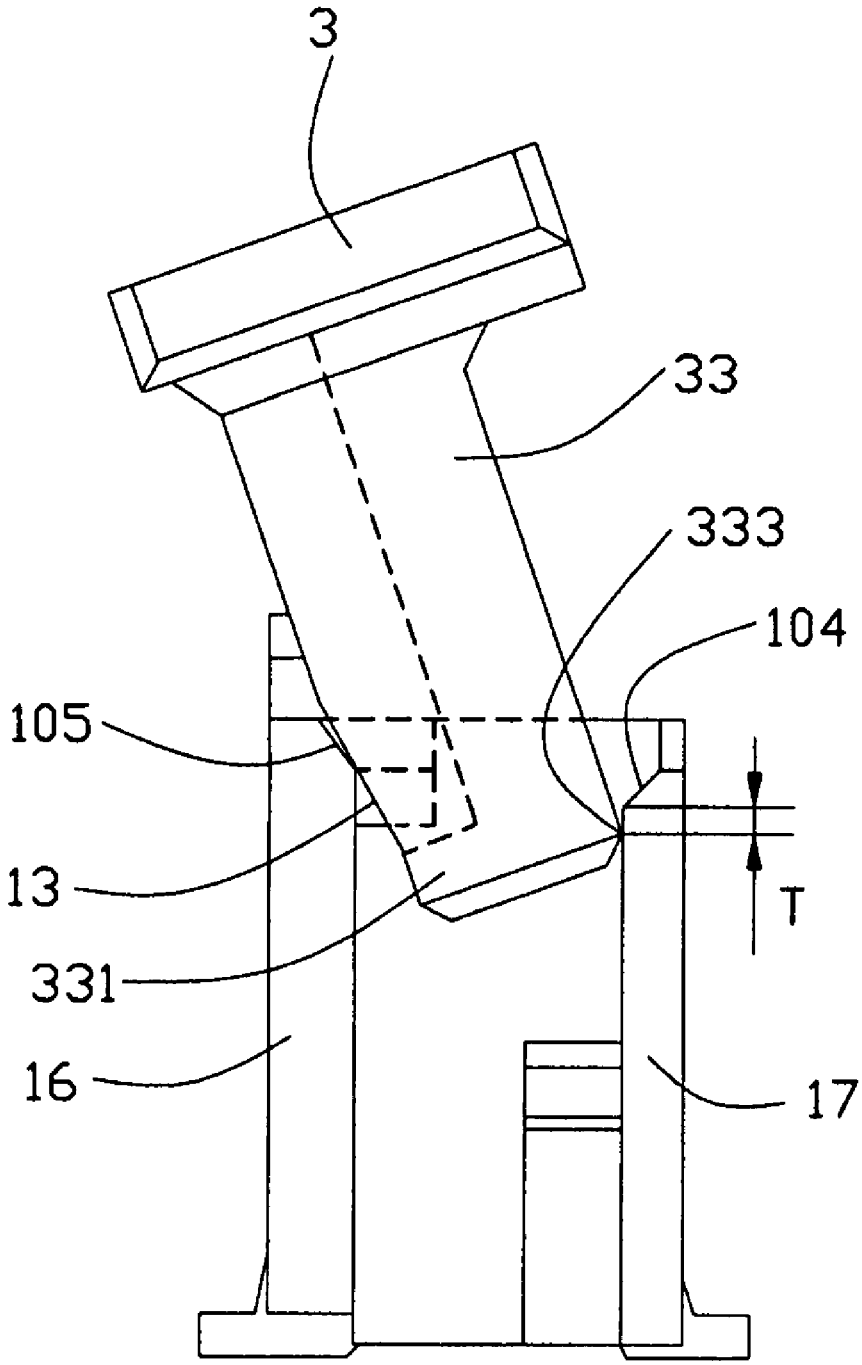
FIG. 6 is a side-view of the electrical connector shown in FIG. 1, wherein the slider inclines against a long wall.

Referring to FIG. 6, showing the process of slider 3 divorced from the housing. First rotate the slider 3 which is often lead against the second retaining wall 17 in the open-position to the first retaining wall 16, wherein a distal end 333 of the latching arm 33 is touched with an inner side of the second retaining wall 17 near the slanting surface 104 and an interface is defined. The distance of the interface figured as "T", which can be in range of 0.1 mm to 0.3 mm, is 0.18 mm in the preferred embodiment of the invention. Normally, the interface "T" prevents the slider 3 from breaking off the housing. However, if the slider 3 is need to be replaced, the distal ends 333 of the latching arms 33 will surpass the interface "T" when an enlarged force is exerted on the slider 3, thus the slider is taken out.

Assembling the slider 3 into the housing 1 is in the same way. First put the grasping portion 331 of the latching arm 33 under the first latching portion 13, wherein the distal end 333 is blocked by the top of the interface. Then an enlarged force is exerted on the slider 3 to make the distal end 333 surpass the interface "T". Thus the slider 3 is assembled into the housing 1.

The slider 3 of the invention is easily assembly into and divorced from the housing 1 without damaging the latching arms 33, therefore the slider 3 is easily to be replaced if it is damaged.

The present invention is not limited to the electrical connector 100 mentioned above. This disclosure is illustrative only, changes may be made in detail, especially in matter of shapes, size, and arrangement of parts within the principles of the invention. For example, the distance "T" can be changed from 0.1 mm to 0.3 mm.

What is claimed is:

1. An electrical connector comprising:

an insulative housing comprising a first sidewall, a second sidewall opposite and parallel to the first sidewall and two opposite endwalls connecting said first and second sidewalls, a receiving cavity defined therebetween with an opening, a first and a second retaining walls located on each of said two endwalls and a first latching portion defined on said each endwall and contacted the first retaining wall;

a plurality of terminals with at least one resilient arm located on the first sidewall and a fixing arm retained in the second sidewall; and a slider comprising a tongue plate insertable to said receiving cavity and a pair of latching arms spaced to the tongue plate and sliding between the said first and second retaining walls;

wherein a groove is formed between said first and second retaining walls with an entry adjacent to the opening of the receiving cavity, each of the latching arms is assembled in the groove through the entry;

wherein the at least one resilient arm is longer than the fixing arm and the first retaining wall is longer than the second retaining wall;

wherein a grasping portion is defined at a distal end of the each latching arm to cooperate with said first latching portion;

wherein the grasping portion is defined at one side of the each latching arm along an extending direction thereof and a retaining portion is defined at the other side of the each latching arm;

wherein a second latching portion is defined in a middle portion of said groove and contacted the second retaining wall to cooperate with the retaining portion of said each latching arm;

wherein said first and second retaining walls are integrally formed by the first and second sidewalls, respectively, and extending beyond corresponding the endwalls; and wherein an interface is defined on an inner side of the first retaining wall near said entry, the each latching arm surpass said interface to go into or out said groove by an enlarged force exerted on the slider.

2. The electrical connector as described in claim 1, wherein a distance of the interface is in scope of 0.1 mm to 0.3 mm.

* * * * *